United States Patent [19]

Colclough et al.

[11] 4,115,287

[45] Sep. 19, 1978

[54] LUBRICATING COMPOSITIONS

[75] Inventors: Terence Colclough; Brian Swinney, both of Oxford, England

[73] Assignee: Exxon Research and Engineering Company, Linden, N.J.

[21] Appl. No.: 779,060

[22] Filed: Mar. 18, 1977

[30] Foreign Application Priority Data

Apr. 22, 1976 [GB] United Kingdom ..... 16360/76

[51] Int. Cl.[2] ..... C10M 1/38; C10M 3/32; C10M 5/28; C10M 7/36

[52] U.S. Cl. ..... 252/48.2; 260/608; 260/609 R

[58] Field of Search ..... 252/48.2

[56] References Cited

U.S. PATENT DOCUMENTS

| | | | |
|---|---|---|---|
| 2,451,345 | 10/1948 | McNab et al. | 252/42.7 |
| 2,836,565 | 5/1958 | Elliott et al. | 252/47.5 |
| 3,057,926 | 10/1962 | Coffield | 260/608 X |
| 3,250,712 | 5/1966 | Coffield | 252/48.2 |
| 3,429,814 | 2/1969 | Myers et al. | 252/48.2 |
| 3,479,407 | 11/1969 | Laufer | 260/608 |
| 3,647,885 | 3/1972 | Geering et al. | 260/608 |
| 3,745,117 | 7/1973 | Fujisawa et al. | 252/48.2 |
| 3,844,964 | 10/1974 | Kennedy | 252/48.2 |
| 3,929,654 | 12/1975 | Brewster et al. | 252/48.2 |

*Primary Examiner*—Helen M. S. Sneed
*Attorney, Agent, or Firm*—Frank T. Johmann

[57] ABSTRACT

Lubricating oil containing a sulfurized dihydroxy benzene of formula

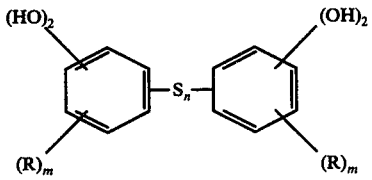

where $n$ is 1 to 4, $m$ is 1 to 3 and R is an alkyl group containing at least 7 carbon atoms. These compounds impart anti-rust and anti-oxidancy to the oil with reduced copper corrosion.

11 Claims, No Drawings

LUBRICATING COMPOSITIONS

The present invention relates to lubricating compositions and in particular to lubricating compositions containing additives to improve the antirust and antiwear properties of the lubricant. The invention is primarily concerned, with mineral lubricating oils such as those used for lubrication of internal combustion engines.

It is important that a lubricant be stablized against oxidation at the temperatures at which it is used as decomposition products are formed by oxidation of an oil the viscosity of the oil increases and it becomes a worse lubricant. It has been proposed in for example our own copending application No. 1980/73 published as U.K. Patent specificaton No. 1,404,714 that sulfurized alkyl phenols may be incorporated into lubricating oils to give improved oxidation stability. Water is formed as a combustion product in operation of the internal combustion engine and this water tends to pass into the engine where it causes rusting and considerable engine damage. The preence of the sulfurized alkyl phenol antioxidant makes little if any contribution to preventing this formation of rust.

It is known to incorporate additives into lubricating oils to inhibit rust formation but many of these are metal containing and tend to produce deposits known as ash when they decompose. Ash is undesirable since it contaminates the oil and it is highly desirable to reduce the amount of ash especially since in certain lubricants it is necessary to incorporate highly basic dispersant additives such as highly basic calcium or magnesium phenates and sulphonates which are themsleves ash forming and it is therefore important that other additives that are incorporated yield as little ash as possible and are preferably metal free.

We have now found that certain sulfurized dihydroxy alkyl benzenes have good rust prevention properties when incorporated into lubricating oils and retain at least some of the antioxidant properties of the corresponding sulfurized alkyl phenols. In addition we find that the presence of a sulphurized dihydroxy alkyl benzene, especially a sulfurized alkyl catechol imparts an improvement in the antiwear properties of the lubricant.

We have also found that the method of preparation of the sulfurized alkyl dihydroxy benzene and the nature of the starting materials used in this preparation contribute towards the effectiveness of the product as a lubricant additive.

We are not aware of any suggestion that the particular sulfurized alkyl dihydroxy benzenes with which the present invention is concerned be incorporated into lubricating oils. We are aware of U.S. Pat. No. 2,451,345 which is concerned with the use of metal salts of alkyl phenol sulphides which may include the salts of dihydroxy phenols. These compounds are of course metal containing and therefore ash forming with the attendant problems described above.

We are also aware of U.S. Pat. No. 2,836,565 which is concerned with antioxidants for synthetic diester type lubricants. One example given is the thioether prepared from tertiary butyl catechol but, according to this patent, these compounds have limited usefulness as antioxidants in mineral oils. We agree with this statement and have found that materials containing these comparatively small alkyl groups are not useful as additives in lubricating oils.

We are also aware of United Kingdom Pat. No. 498,046 which is concerned with alkyl diphenol polysulphides which may be dihydroxy phenols which impart antioxidancy to lubricating oils. This Patent No. is primarily concerned with monohydroxy phenols which do not impart anti-rust properties to the lubricating oil and furthermore, as with U.S. Pat. No. 2,836,565 it is concerned with compounds containing comparatively short alkyl chains.

The present invention therefore provides a lubricating composition comprising a lubricating oil containing a sulfurized alkyl dihydroxy benzene of the general formula:

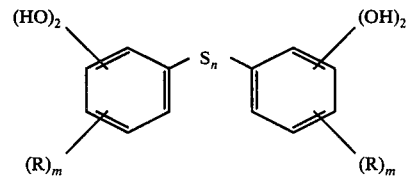

where $n$ is an integer from 1 to 4 and R represents one or more alkyl groups where $m$ is no more than 3 and at least one of such alkyl groups on each aromatic nucleus contains at least 7 carbon atoms.

We prefer that the phenolic groups be in the ortho position relative to each other that is to say that the sulfurized phenol be derived from alkyl catechol. We also prefer that in the general formula only one of the alkyl groups R contains at least 7 carbon atoms. This is necessary to ensure that the sulfurized material is sufficiently soluble in oil to be useful as a lubricant additive. We find however that the compounds are difficult to prepare if the aromatic nucleus carries more than one such alkyl group. We also prefer that the alkyl group containing at least 7 carbon atoms contain no more than 12 carbon atoms since we find that the anti-rust properties imparted diminish if the alkyl group contains more than 12 carbon atoms. We have also found that the antirust properties may be improved if $m$ is 2, one alkyl group containing at least 7 carbon atoms and the other from 1 to 3 carbon atoms. In particular we prefer to use sulfurized alkylated 4 methyl catechol.

The sulfurized alkyl dihydroxy benzene may be prepared by any of the standard conditions used to sulphurize phenols. We prefer that the dihydroxy benzene be catechol or resorcinol or a derivative thereof since we find hydroquinone and its derivatives more difficult to alkylate. Although resorcinol may be alkylated this is more difficult than with catechol derivatives and it is these that are preferred. We have found that the method of sulphurization is important to the extent that the method used determines the particular properties of the final product. We prefer that the product be prepared by reacting the alkyl dihydroxy benzene with a sulphur halide such as sulphur monochloride or sulphur dichloride. We also prefer that the alkyl dihydroxy benzene is pure, i.e. that it contains no more than 5% by weight of the parent dihydroxy benzene which may be achieved by distillation. We find that the use of a purified starting material results in a product of better color than that obtained with the impure material which tends to be black and less soluble in oil. As an alternative we find that if the alkyl dihydroxybenzene is prepared by standard catalysed alkylation of the alkyl dihydroxybenzene with a suitable olefin an acceptable final sulfurized product may be obtained without the need for purification if excess olefin, preferably about 30 to 60% excess olefin is present during the alkylation. We also prefer to sulphurize with sulphur monochloride in the presence of an inert solvent such as carbon tetrachloride. In addition we prefer to use a ratio of more than one mole of alkyl dihydroxy benzene for each mole of sulphur monochloride, most preferably we use an amount in the range 1.5 to 2.5 especially preferred being 2 moles. The products of this process are generally mixtures of compounds containing mainly mono- and disulfide linkages together with a few containing polysulfides linkages. Thus where we give a value for *n* in the general formula of our invention this is an average value and we prefer that *n* be from 1 to 2 inclusive. Some molecules may be polysulfides containing up to 4 sulphur atoms. We also prefer that the products contain no more than 10% of product containing more than one alkyl group on one or both aromatic nucleii.

We have found that the sulfurized alkyl dihydroxy benzenes used in the compositions of the present invention impart anti-rust properties to a lubricating oil which is not achieved using the corresponding alkyl phenol or when using the alkyl dihydroxybenzene alone and yet the sulfurized material retain most of the antioxidant properties of the non-sulfurized material. Thus, the use of the sulfurized materials can enable one to replace at least part of the conventional antioxidant and to obviate the need for a separate anti-rust additive. We have also found that the presence of the sulfurized alkyl dihydroxybenzene imparts some antiwear properties to the lubricating oil and also reduces the extent to which the oil corrodes copper and lead which is important since some bearings in internal combustion engines are made from blends of copper and lead, this is in contrast to using the alkyl dihydroxybenzene itself and other convention antioxidants which tend to worsen engine wear and copper corrosion.

The lubricating oil may be any animal, vegetable or mineral oil for example petroleum oil fractions ranging from naphthas to spindle oil to SAE 30, 40 or 50 lubricating oils or oxidized mineral oils. Although the compositions are generally mineral oils they are also applicable to synthetic ester lubricating oils for example the diesters such as di-octyl adipate, dioctyl sebacate; didecyl azelate, tridecyl adipate, didecyl succinate, didecyl glutarate and mixtures thereof. Other synthetic ester oils to which the invention is applicable include those prepared by reacting polyhydric alcohols such as trimethylol propane and pentaerythritol with monocarboxylic acids such as butyric acid, caproic acid, caprylic acid and pelargonic acid.

We have found that in order to obtain the desired anti-rust properties the lubricating composition of the present invention should contain between 0.01 and 10% preferably from 0.1 to 5%, by weight of the composition of the sulfurized alkyl dihydroxy benzene. The composition may however consist of a concentrate of the sulfurized alkyl dihydroxy benzene in oil which is supplied for incorporating into bulk lubricating oil. In this instance the concentrate may contain up to 10% by weight of the sulfurized alkyl dihydroxy benzene.

The lubricating composition may contain any of the other types of additives that are generally included in lubricating oils. For example the composition may contain ashless dispersants such as the polyamine long chain mono- or di-carboxylic acid or acid anhydride condensation products. Indeed it is preferred to have an ashless dispersant present since it aids the solubility of the sulfurized alkyl catechol in mineral oils and can prevent haze and sediment developing when the oil stands for some time. Any of the well-known dispersants may be used and examples include amides or imides of dicarboxylic acids or anhydrides or tri and higher polycarboxylic acids and anhydrides said acid or anhydride having at least 30 carbon atoms per molecule with a polyamine. Thus, the acid or anhydride may have a molecular weight of about 500 and preferred acids or anhydrides are those having a molecular weight of between 600 and 3000, e.g., between 800 and 1800. These carboxylic acids and anhydrides are conveniently derived from a polymer of a mono-olefin, e.g., a $C_2$ to $C_5$ mono-olefin, such as polyethylene, polypropylene or polyisobutene.

Dicarboxylic acid anhydrides having a relatively long chain may conveniently be made by the reaction of maleic anhydride with a long-chain olefin or a halogenated long-chain olefin. The preferred olefins are polymers of mono-olefins, especially those described above with reference to making long-chain mono-carboxylic acids. Thus, one may react a polyisobutene of molecular weight between 600 and 3000 or the halogenated derivative thereof with maleic anhydride to give an alkenyl succinic anhydride. The two reactants may be merely heated together at a temperature of between 150° and 200° C. The corresponding acids can be made by hydrolyzing the anhydrides. A particular example of a long chain dicarboxylic acid is polybutenyl succinic acid of MW approximately 1000.

The amide or imide is derived from a polyamine and this is preferably a oolyalkylene polyamine. Suitable polyalkylene polyamines include those of the formula:

$$H_2N(CH_2)_n)_m—(NH(CH_2)_n)_m—NH(CH_2)_nNH_2$$

where *n* is 2 or 3 and *m* is zero or an integer of 1 to 10. Thus suitable polyalkylene polyamines are the polyethylene and polypropylene polyamines such as diethethylene triamine, triethylene tetramine, tetraethylene pentamine, octaethylene nonamine and tetrapropylene pentamine.

Preferred examples are the reaction products of polyisobutenyl succinic anhydride of molecular weight between 600 and 3000, e.g. about 1000 and a polyethylene polyamine, e.g., tetraethylene pentamine. These reaction products are usually mixtures of amide and imide, mainly imide. Thus one may use the reaction product of polyisobutenyl succinic anhydride (MW about 1000) and tetraethylene pentamine in a mole ratio of 1.3:1 respectively. This amide/imide mixture has a nitrogen content of 2.1–2.4 wt.% and a TBN of about 50. One could also use the reaction product of polyisobutenyl succinic anhydride (MW about 1000) and tetraethylene pentamine in a mole ratio of 2.1:1 respectively. This amide/imide mixture has a nitrogen content of at least 1.45 wt.%, typically 1.5 to 1.6 and a TBN of 25 to 35. Another particularly suitable example is the reaction product of polyisobutenyl succinic anhydride (MW about 1000) and tetraethylene pentamine in a mole ratio of 2.8:1. This amide/imide mixture has a nitrogen content of about 1.2 wt.% and a TBN of about 22.

An alternatives to the above mentioned amide/imide mixtures one could use them after they have been reacted with boric acid. In some circumstances these borated dispersants show certain advantages, e.g., better control over piston deposits in diesel engines. These borated dispersants are also amide/imide mixtures which may be prepared by reacting the dispersant with boric acid to give a boron content in the finished dispersant of from 0.05 to 1.0 wt.%.

Other additives that may be present include highly basic dispersants such as the overbased calcium and magnesium sulphonates and phenates as may conventional antioxidants such as the zinc dithiophosphates and the phosphorous sulphide olefin condensation products, although smaller amounts of the antioxidant than is generally used will be required due to the antioxidant properties of the sulphurised alkyl dihydroxy benzene. Other additives that may be incorporated in the lubricating composition include viscosity index improvers such as ethylene vinyl acetate copolymers or other olefin copolymers based on ethylene and antiwear additives such as the sulphur containing heterocyclic compounds. Some or all of these other additives may be included in the concentrate when the sulfurized alkyl dihydroxy benzene itself is supplied as a concentrate.

The present invention is illustrated but in no way limited by reference to the following examples.

EXAMPLE 1

Nonyl catechol was prepared by charging 15 kilograms of catechol, 17 kilograms of of nonene and 0.818 kilograms of Amberlyst 15 as catalyst into a 50 liter glass reactor and stirred at 100° C for 21 hours. The product was filtered and stripped at 150° C under a pressure of 43 millimeters of mercury.

10 Kilograms of the product were then charged together with 10 liters of carbon tetrachloride into a 50 liter glass reactor. The temperature of the solution was cooled to below 10° C and 2.86 kilograms of sulfur monochloride added over a period of 4 hours ensuring that the temperature did not rise above 15° C. Finally the carbon tetrachloride was distilled off to yield 11.35 kilograms of sulfurized nonyl catechol.

The product was soluble in mineral oil yielding a black solution.

EXAMPLE 2

Nonyl catechol was prepared by the same process as Example 1 and distilled at 136°–156° C at 0.1 mm mercury to purify the product. 9 Kilograms of this distilled nonyl catechol were then charged to the glass reactor together with 9 liters of carbon tetrachloride. 2.58 kilograms of sulfur monochloride were then added over a period of 4 hours whilst the reactor was held at a temperature of from 9° to 11° C. Finally the carbon tetrachloride was distilled off at 102° C under a pressure of 52 millimeters of mercury.

The product was soluble in mineral oil to give a clear stable solution. The solution was also stable when an ashless dispersant was present.

EXAMPLE 3

15 Kilograms of catechol and 25.77 kilograms of nonenes were heated together with 0.414 kilograms of Amberlyst 15 as catalyst. Initially 70% of the nonenes were added together with the catechol and the mixture heated to 96° C, the exotherm took the temperature to 144° C, was then cooled to 100° C and the remainder of the nonenes added and the vessel then heated to 130° C for 4¾hours. The product was separated and stripped at 154° C at atmospheric pressure and then at 150° C at 62 millimeters mercury pressure for 6 hours.

Analysis of the product showed less than 4% by weight of catechol, 17.5% by weight of dinonyl catechol, 63% of 4 nonyl catechol and 0.9% of 3nonyl catechol.

9 Kilograms of this product were charged to a glass vessel together with 9 liters of carbon tetrachloride. 2.58 Kilograms of sulfur monochloride was added slowly over a period of 4 hours whilst the temperature was held between 9° and 11° C. Hydrochloric acid was removed by a caustic scrubber and when all the sulfur monochloride had been added the product was allowed to warm up to room temperature and then stirred for 1 hour at this temperature. Finally the carbon tetrachloride was distilled off at 102° C at 52 millimeters mercury pressure.

Analysis of the product showed:

| | |
|---|---|
| Nonyl Catechol | 19.0 wt.% (not sulfurized) |
| Dinonyl Catechol | 16.0 wt.% (not sulfurized) |
| Sulfur | 11.0 wt.% |
| Chlorine | 1.6 wt.% |

It was found that whilst most of the original monononyl material was sulfurized the dinonyl material remained unsulphurised. The product was soluble at 1% in mineral oil although the solution was somewhat hazy, a clear stable solution was obtained when 3% by weight of a conventional polyamine dispersant was added.

EXAMPLE 4

Various sulfurized alkyl catechols were prepared using in one process a crude alkyl catechol as used in Example 1 and reacting the crude alkyl catechol with a sulfur chloride in a toluene solution in the presence of an iron catalyst (Process A). In a second series of preparations purified alkyl catechol as used in Example 2 was reacted with a sulfur chloride in a carbon tetrachloride solution (Process B).

The reaction may be summarized as:

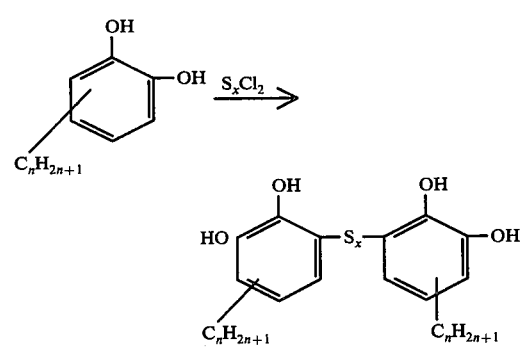

Samples of each of the sulfurized alkyl catechols were incorporated into a 10W/30 0.5% sulphonated ash lubricating oil formulated to MIL-L-46152 specification containing 6.0% by weight of a polyamine ashless dispersant, zinc dithiophosphate antiwear agent and an overbased metal dispersant.

Each oil was then subject to the MS IIC rust test (published in the ASTM STP 315F) in which an Oldsmobile V8 engine is operated for 32 hours with the lubricating oil and the engine then dismantled and the rusting of the parts evaluated and given a merit rating from 0 to 10, 10 representing no rusting.

The results obtained were as follows, the values of $n$ and $x$ referring to the formula given above:

| n | x | Process Used | Alkyl Catechol $S_xCl_2$ | % of Sulfurized Alkyl Catechol in Oil | MS IIC Rating |
|---|---|---|---|---|---|
| — | — | — | — | 0 | 5.5 |
| 9 | 1 | A | 1.2 | 1.0 | 7.0 |
| 9 | 1 | B | 2 | 1.0 | 8.5 |
| 9 | 2 | B | 1.2 | 1.0 | 8.5 |
| 9 | 2 | A | 2 | 1.0 | 8.1 |
| 12 | 2 | B | 2 | 1.0 | 8.5 |
| 12 | 1 | B | 2 | 1.0 | 7.8 |
| 9 | 2 | B | 2 | 0.8 | 7.8 |
| 8 | 2 | B | 1.2 | 0.8 | 8.4 |
| 9 | 2 | B | 2 | 1.0 | 8.6 |

EXAMPLE 5

1.0% by weight of the product of Example 2 was included in a 10W/50 lubricating oil 0.5% ash containing 6.0% by weight of a polyisobutylene succinic anhydride/polyamine ashless dispersant and the bearing corrosion of the oil determined by the L38 corrosion test (SAE publication 680538).

The performance of these oils were compared with the performance of oils containing 0.46% by weight of a 70% active material dodecenyl succinic acid and 0.8% by weight of the reaction product of styrene and the condensation product of $P_2S_5$ and a $C_9$ alkyl phenol 8.0 wt.% active ingredient containing about 7 wt.% sulphur and about 3.5 wt.% phosphorous.

The bearing weight loss of the oil containing the sulfurized alkyl catechol was 76 milligrams whilst that of the other oil was 494 grams.

The tests described above were repeated using as dispersant the same product as was used previously but reacted with boric acid. In this instance the bearing weight loss of the oil containing the sulphurised alkyl catechol was 54 milligrams whilst that of the other oil was 170 milligrams.

EXAMPLE 6

The antioxidancy of the sulfurized alkyl catechol used in Example 5 was evaluated and compared with oils containing standard additives such as the dodecenyl succinic acids (DDS Acid) and styrene condensation products used for comparison in Example 5. The experiments were carried out in a 10W/30 oil in an Oldsmobile V8 engine operated for 64 hours (test published in ASTM STP 314F) with the viscosity increase in the oil being measured after 40 hours and 64 hours. At the end of the 64 hour run merit ratings are given to the amount of sludge in the oil and piston skirt varnish on a scale from 0 to 10.

The results may be summarized as follows:

| Formulation: | | | | | |
|---|---|---|---|---|---|
| Dispersant | | 6.0 % | 6.0 % | 6.0% | 6.0% |
| DDS Acid (70% active ingredient) | | 0.43% | 0.43% | | |
| Styrene/$P_2S_5$/$C_9$ Alkyl Phenol 80% Active Ingredient | | 0.8 % | 1.4 % | | 0.6% |
| Sulfurized Alkyl Catechol (70% active ingredient) | | | | 0.8% | 0.8% |
| **Test Result:** | | | | | |
| % Viscosity increase | 40 hours | 159 | 49 | 46 | 43 |
| | 64 hours | Too Viscous | Too Viscous | 3400 | 401 |
| | Sludge | 9.0 | 9.4 | 9.46 | 9.53 |
| | Varnish | 9.4 | 9.5 | 9.26 | 9.48 |

EXAMPLE 7

The antiwear effect of sulphurized alkyl catechol was evaluated in a 10W/30 oil formulation containing 6.0% by weight of an ashless dispersant, and 1.0% by weight of the sulfurized nonyl catechols by the Hertz 4 ball wear test under a load of 120 kilograms for 1 minute. The performance was compared with a similar oil containing a zinc dialkyldithiophosphate and one that is free of antiwear additives. The results were as follows:

| Additive | Wear Scar Diameter (mm) |
|---|---|
| Zinc Dialkyldithiophosphate | 2.55 |
| Nonyl Catechol/$S_2Cl_2$ 2 : 1 | 1.90 |
| Nonyl Catechol/$SCl_2$ 2 : 1 | 2.40 |
| None | 3.0 |

EXAMPLE 8

The antioxidancy of various sulfurized alkyl catechols in oil was evaluated in the Differential Scanning Calorimeter (DSC) test and the Modified Catalysed Oxidation Test (Mod COT).

In the DSC test an oil sample in an aluminum pan is heated in air at 210° C and 100 psi pressure. After a period of time (the induction time) the oil oxidizes and the heat of oxidation recorded. The induction time and the heat of oxidation, are then computed according to the formula:

$$L = 1.5188 \log(\text{induction time in minutes}) - 0.3167 \log(\text{heat of oxidation in calories/gram})$$

to give what is known as the "$L$" value, the lower the value the better the antioxidancy.

In the Mod COT test an oil sample containing 0.1 wt.% iron naphthenate is stirred with a paddle made from a Petter W-1 engine bearing with air blowing at 171° C for 48 hours and the percentage change in viscosity is measured.

The results were compared with oils containing a standard $P_2S_5/\alpha$ Pinene condensation product as antioxidant.

| Antioxidant | Treat Rate | DSC < Value | Mod COT % Viscosity Increase 30 hours | Mod COT % Viscosity Increase 48 hours |
|---|---|---|---|---|
| $P_2S_5/\alpha$ Pinene) | 0.8% | 1.0 | 23% | 3600% |
| Sulfurized | 1.4% | 1.0 | 10% | 260% |
| Nonyl) | 0.8% | 1.3 | 53% | 370% |
| catechol (Catechol : $S_2Cl_2$ = 2:1) | 1.3% | 1.6 | 25% | 600% |
| Sulfurized dodecyl) | 0.8% | 72 | 6% | 134% |
| Catechol (Catechol : $S_2Cl_2$ = 2:1) | 1.3% | 1.64 | 16% | 470% |
| Sulfurized Heptyl) | 0.8% | 1.3 | 6% | 274% |
| Catechol) (Catechol:$SCl_2$ = 2:1) | 1.4% | 72.0 | 34% | 560% |

EXAMPLE 9

The copper corrosion properties of oils containing various sulfurized alkyl catechols were measured according to the copper corrosion test ASTM D 130. In the test 1.0% by weight of the sulfurized alkyl catechol was incorporated in the oil of Example 5 and the results were as follows:

| Alkyl Group | $S_xCl_2$ | Cat : $S_xCl_2$ | Cu Strip Rating |
|---|---|---|---|
| $C_7$ | $SCl_2$ | 2:1 | 1a |
| $C_9$ | $SCl_2$ | 2:1 | 1a |
| $C_9$ | $S_2Cl_2$ | 2:1.7 | 1a |
| $C_{12}$ | $S_2Cl_2$ | 2:1 | 2a |
| $C_{12}$ | $SC_{12}$ | 2:1.7 | 2a |

showing that the presence of the catechol derivative did not adversely affect the copper corrosion of the oil.

EXAMPLE 10

The antirust properties of sulfurized alkyl catechols were compared with that of the corresponding sulfurized alkyl phenols and those of unsulphurized alkyl catechols. The various oils contained 5.0% by weight of a conventional polyamine dispersant and 0.5% by weight of the additive. The antirust properties were evaluated by the modified ASTM D 665 test in which a standard steel pin is submerged in 300 mls of a mixture of the oil and N/5 hydrochloric acid held at 140° F for 24 hours and the amount of rusting observed.

The results of the tests were as follows:

| Additive | Test Result |
|---|---|
| Sulfurized Nonyl Phenol Nonyl Phenol/$SCl_2$ 2 : 1 | Heavy Rust |
| Sulfurized Nonyl Phenol Nonyl Phenol/$S_2Cl_2$ 2 : 1 | Heavy Rust |
| Sulfurized Nonyl Catechol Nonyl Catechol/$SCl_2$ 2 : 1 | No Rust |
| Sulfurized Nonyl Catechol Nonyl Catechol/$S_2Cl_2$ 2 : 1 | No Rust |
| Nonyl Catechol | Heavy Rust |

EXAMPLE 11

Comparative MS IIC tests (as used in Example 4) were carried out on two MIL-L-46152 0.5% ash SAE 10W-30 lubricating oils, similar to those of Example 4 except that one oil contained 0.8% by weight of nonyl catechol and the other 0.8% by weight of dodecyl succinic acid. The rust rating for the oil containing nonyl catechol was 5.9 with 16 stuck lifters whilst that for the oil containing dodecyl succinic acid was 8.8 with no stuck lifters.

EXAMPLE 12

By way of comparison the corrosion properties of two MIL-L-46152 0.5% ash SAE 10W-30 oils one containing 0.8 wt.% of nonyl catechol and the other contaning 1.3 wt.% of nonyl catechol were determined by the test used in Example 5. The weight loss of the bearings in the oil containing 0.8 wt.% nonyl catechol was 329 milligrams whilst that of the oil containing 1.3 wt.% nonyl catechol was 517 milligrams.

EXAMPLE 13

For the sake of comparison a sample of sulphurized 4-tertiary butyl catechol was prepared by reacting 2 moles of tertiary butyl catechol with one mole of sulfur monochloride using substantially the process of Example 2.

The product was found to be totally insoluble in mineral oil and the solubility was not improved by the addition of as much as 5% by weight of the conventional polyamine dispersant.

EXAMPLE 14

200 Grams of 4-methyl catechol, 312 grams of nonene and 10.8 grams of Amberlyst 15 as catalyst were stirred together at 120° C for 8 hours. The catalyst was then removed by filtration and excess olefin removed by distillation at 100° C and 30 millimeters of mercury pressure. The residue was purified by distillation and the fraction distilling at 130° C at 0.4 mm of mercury pressure collected and analysis showed this fraction to be a mixture of the 3 isomers of nonyl-4-methyl catechol.

193 Grams of this alkylated 4-methyl catechol were dissolved in 100 mls of carbon tetrachloride the solution cooled to below 10° C and treated with a solution of 31.2 mls of sulfur monochloride in 68.8 mls of carbon tetrachloride. The solvent was removed by distillation at 100° C and 2 millimeters mercury to yield a residue containing 11.5 wt.% sulfur.

0.5 wt.% of the product which was soluble in lubricating oils was incorporated into a 1.0 wt.% sulphated ash SAE 30 grade lubricating oil containing other lubricant additives and compared with similar lubricating oils containing 0.5 wt.% of the sulfurized nonyl catechol prepared according to Example 2. The MS IIC test used in Example 4 was the basis for the comparison and the oil containing the product of this Example gave a rating of 8.8 whilst that containing the sulfurized catechol gave a rating of 8.3.

EXAMPLE 15

5.4 Moles of resorcinol, 6.54 moles of nonene and 32 grams of Amberlyst 15 as catalyst were stirred together at 130° C for 3 hours and the crude product purified by distillation. 225 Grams of this nonyl resorcinol was sulfurized with 38.4 mls of sulfur monochloride dissolved in carbon tetrachloride.

The product was purified and incorporated into a paraffinic mineral oil contaning 5.5 wt.% of an ashless dispersant. The oil was then subjected to the ASTM D 665 test used in Example 10 and an oil containing 1.0 wt.% of sulfurized nonyl resorcinol was found to pass the test whilst an oil containing 0.5 wt.% of sulfurized nonyl resorcinol failed due to light rusting of the pin.

0.5% of the sulfurized nonyl resorcinol was incorporated in the lubricating oil used in Example 14 in place of the sulfurized nonyl-4-methyl catechol and the oil subjected to the MS IIC test to give a rating of 8.0.

We claim:

1. A lubricating oil composition comprising a major amount of a lubricating oil and from 0.01 to 10% by weight of a sulfurized alkyl dihydroxy benzene of the general formula:

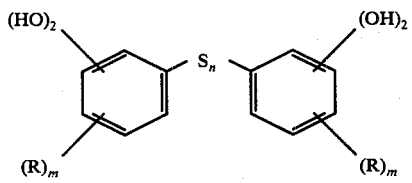

where $n$ is an integer from 1 to 4, $m$ is an integer from 1 to 3, R represents an alkyl group with the restriction that at least one of said alkyl groups on each aromatic nucleus contains at least 7 carbon atoms, said % by weight based on the total weight of said composition.

2. A lubricating oil composition according to claim 1 wherein the dihydroxy groups are ortho relative to each other.

3. A lubricating oil composition according to claim 1 wherein said alkyl group or groups containing at least 7 carbon atoms contain no more than 12 carbon atoms.

4. A lubricating oil composition according to claim 1 wherein said composition contains less than about 5 weight percent of sulfurized and non-sulfurized dihydroxy benzene, said weight percent based on the concentration of said sulfurized alkyl dihydroxy benzene.

5. A lubricating oil composition according to claim 1 wherein said lubricating oil is a mineral oil.

6. A lubricating oil according to claim 1 wherein said lubricating oil is a synthetic oil.

7. A lubricating oil composition according to claim 1 wherein said sulfurized alkyl dihydroxy benzene is present in from 0.1 to 5% by weight and said composition further contains a dispersant of the class selected from ashless dispersants, borated ashless dispersants and highly basic dispersants.

8. A lubricating oil composition according to claim 2 wherein said sulfurized alkyl dihydroxy benzene is sulfurized alkylated 4 methyl catechol.

9. A method of making a sulfurized alkyl dihydroxy benzene having antirust activity in lubricating oil compositions comprising the steps of:

1. catalytically alkylating a dihydroxy benzene with an olefin containing from seven to twelve carbons until a $C_7$–$C_{12}$ alkyl dihydroxy benzene is obtained;
2. reacting said $C_7$–$C_{12}$ alkyl dihydroxy benzene with a sulfur halide in the presence of an inert solvent and in a molar ratio of said benzene to said sulfur halide range from 1.5 to 2.5:1; and,
3. distilling off said inert solvent whereby said sulfurized alkyl dihydroxy benzene is recovered.

10. A method of making a sulfurized alkyl dihydroxy benzene according to claim 9 wherein said alkylation is conducted with olefin excess of 30 to 60% and said dihydroxy benzene is catechol, said sulfur halide is sulfur monochloride and said inert to solvent is carbon tetrachloride.

11. A method according to claim 9 wherein the product of said catalytically alkylating is purified until it contains no more than 5% by weight of said dihydroxy benzene, said % by weight based on the weight of said $C_7$–$C_{12}$ alkyl dihydroxy benzene product.

* * * * *